US005245879A

United States Patent [19]

McKeon

[11] Patent Number: 5,245,879

[45] Date of Patent: Sep. 21, 1993

[54] FAIL-SAFE FIRE DOOR RELEASE MECHANISM HAVING AUTOMATIC RESET

[75] Inventor: James M. McKeon, Brooklyn, N.Y.

[73] Assignee: McKeon Rolling Steel Door Co., Inc., Brooklyn, N.Y.

[21] Appl. No.: 880,094

[22] Filed: May 7, 1992

[51] Int. Cl.[5] ..... G05G 17/00; E05F 15/20; E06B 9/74

[52] U.S. Cl. ..... 74/2; 49/4; 49/199; 160/7; 160/9; 160/188

[58] Field of Search ..... 49/1, 3, 4, 7, 199; 16/48.5; 160/1, 7, 9; 74/2; 292/DIG. 66; 188/163

[56] References Cited

U.S. PATENT DOCUMENTS

| | | | |
|---|---|---|---|
| 774,855 | 11/1904 | Smith | 49/3 X |
| 1,594,721 | 8/1926 | Gilmore | 160/9 |
| 3,207,273 | 9/1965 | Jurin | 49/7 |
| 3,955,840 | 5/1976 | Rawls et al. | 292/229 |
| 5,203,392 | 4/1993 | Shea | 160/7 |

FOREIGN PATENT DOCUMENTS

| | | | |
|---|---|---|---|
| 576202 | 3/1946 | United Kingdom | 49/3 |

OTHER PUBLICATIONS

U.S. Patent Application Ser. No. 07/859833, filed Mar. 30, 1992 Inventor: Tsung-Wen Shea; Title: A Mechanism for Controlling the Raising and Lowering of a Door.

*Primary Examiner*—Allan D. Herrmann

*Attorney, Agent, or Firm*—Cohen, Pontani, Lieberman & Pavane

[57] ABSTRACT

A resettable fail-safe fire door release mechanism which allows normal powered operation of a fire door is disclosed. A solenoid having a first open state in the absence of an applied electric current and a second closed state in the presence of an applied electric current is incorporated into the motor-operator unit of an overhead door. Brake actuator utilizes the spring force of a normally disengaged brake to keep the brake actuator in a first position. The plunger of the solenoid acts through the brake actuator in opposition to the spring so that energizing the solenoid overcomes the force of the spring, moving the brake actuator, and engaging the brake; deenergizing the solenoid causes the spring to again disengage the brake. A normally closed switch having a mechanical actuator is wired in series with the solenoid. The melting of a fusible link releases a spring loaded plunger which depresses the actuator opening the switch. A cable having one end connected to the actuator of the switch and the other end external to the case of the motor-operator allows manual opening of the switch and hence closing of the door.

5 Claims, 3 Drawing Sheets

FAIL-SAFE FIRE DOOR RELEASE MECHANISM HAVING AUTOMATIC RESET

BACKGROUND OF INVENTION

This invention is concerned with operator units for fire doors having a resettable fail-safe release mechanism.

Release mechanisms for roll type fire doors are well known in the art. Release mechanisms presently in use incorporate both a fusible link in series with a chain connected to the closing mechanism of the door, and an electromechanical arrangement responsive to a signal from a fire detecting device in series with said chain. Melting of either the fusible link or activation of the electromechanical arrangement by an alarm signal or power failure will release the chain thereby activating the closing mechanism of the door. U.S. Pat. No. 3,955,840 (Rawls et. al.) describes a door release mechanism that operates using this principle. Furthermore, the invention of Rawls et. al. can be used in the fail-safe mode, whereby the absence of electrical power (which often precedes a fire) will cause the fire door to close. Fail-safe operation is therefore the preferred mode for fire door release mechanisms.

The problem with these and similar mechanisms is that they need to be manually reset after activation. A heavy unpowered door must be raised, the chain rerouted and manually reconnected. This process takes about 20 minutes for most doors and requires experienced factory personnel to meet insurance company requirements. Nuisance activation of fail-safe systems caused by electrical outages is bothersome and expensive because manual resetting is needed every time there is an electrical outage. Several manufacturers have put time delays of up to 60 seconds into the system so that brief outages will not trigger false alarms. Although this minimizes the number of false alarms, it does not affect the cost nor time of reset. Furthermore a time delay of over a few seconds in fire door systems is dangerous because it defeats the purpose of quick door closing in response to alarm system signals.

The National Fire Protection Association (NFPA) specification NFPA 80 1990 edition titled "Standard for Fire Doors and Windows" added a requirement (section 15-2.4.3) which states, among other things, that rolling fire doors must be ". . . tested annually to check for proper operation and full closure." This must be done and adds considerable time and expense per door tested. Some insurance company regulations require biannual testing of fire doors in factories that they insure. Every time a door of the present art is fully tested in accordance with NFPA 80, the above described manual resetting process must be performed.

Patent application Ser. No. 859,833, filed on Mar. 30, 1992 and titled "A Mechanism for Controlling the Raising and Lowering of a Door" (Tsung-Wen Shea, inventor) discloses a mechanism for regulating the speed of descent of a closing fire door while allowing normal operation of the door during non-emergency conditions. The problem with Tsung's invention is that it is not fail-safe; electric power must be applied for an external alarm system to activate the relay to close the door. During a fire which disables the electricity, only heat activating the fusible link, will close the door.

What is needed is a fail-safe fire door release mechanism that can be reset simply should there be an outage, or during periodic requirements to test the door and the release mechanism.

SUMMARY OF INVENTION

The present invention solves the aforementioned problems with current fire doors, fulfills the aforementioned stated need and is particularly useful in eliminating the expense and inconvenience of resetting fire doors tripped by false alarms or during periodic testing of the doors. In addition, the present invention is easily adaptable to the mechanism disclosed by Tsung to provide fail-safe operation without interfering with the positive attributes of Tsung's mechanism.

A release mechanism having a first open state in the absence of an applied electric current and a second closed state in the presence of an applied electric current is incorporated into the motor-operator unit of an overhead door. The motor-operator unit has a brake which has an engaged state which prevents movement of the door and a disengaged state which allows descent of the door under the door's own weight or other impetus. The release mechanism communicates with the brake such that when the release mechanism is in its first open state, the brake is disengaged and allows descent of the door, and when the release mechanism is in its second closed state, the brake is engaged, holding the door in its current position. The term "motor-operator" includes operators which contain no prime movers, but instead substitute a hand crank or other manual means instead of a motor to power the door.

DESCRIPTION OF PREFERRED EMBODIMENT

Figure 1:
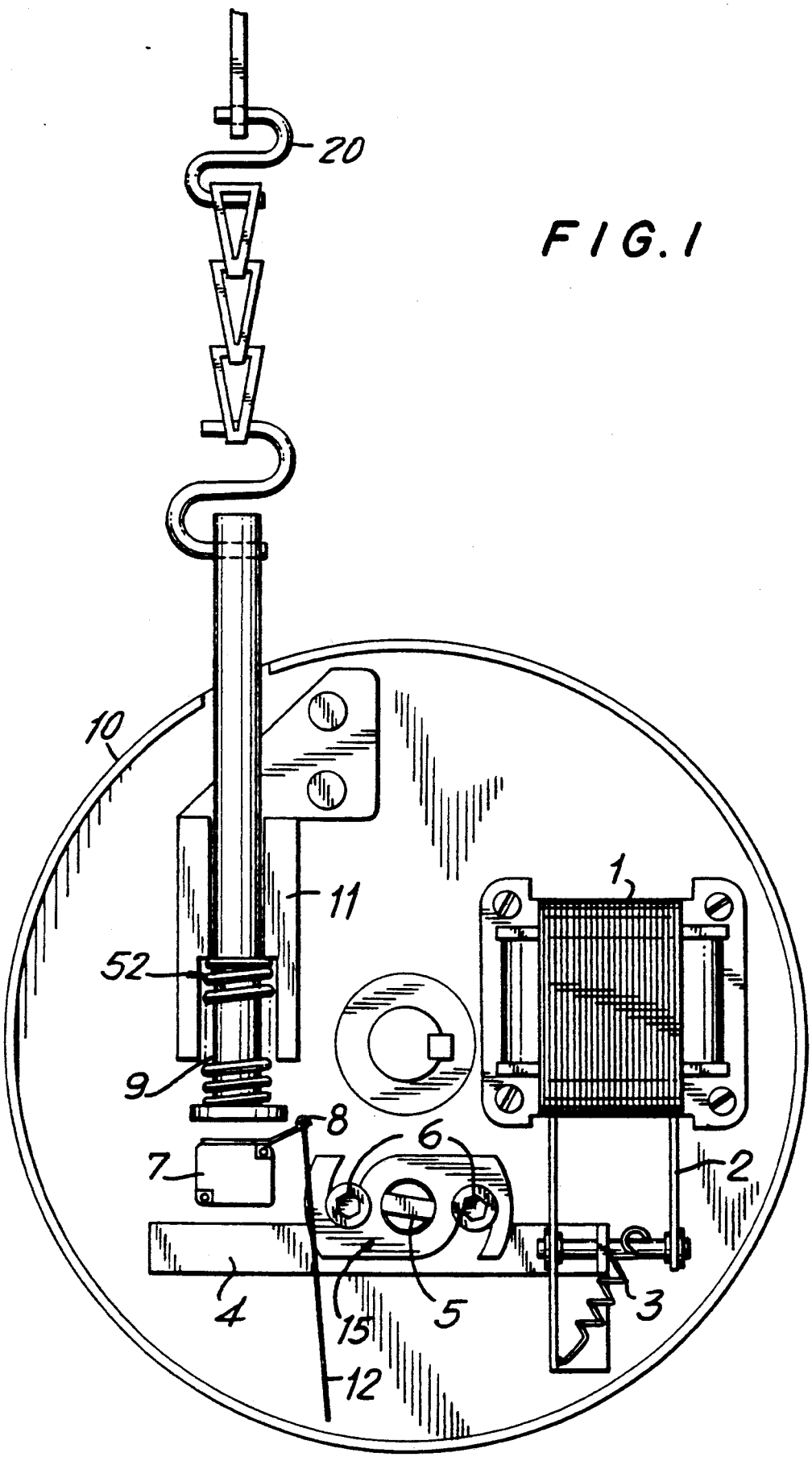
FIG. 1 is a view of the preferred embodiment of the invention showing the release mechanism in its first open state.
Figure 2:
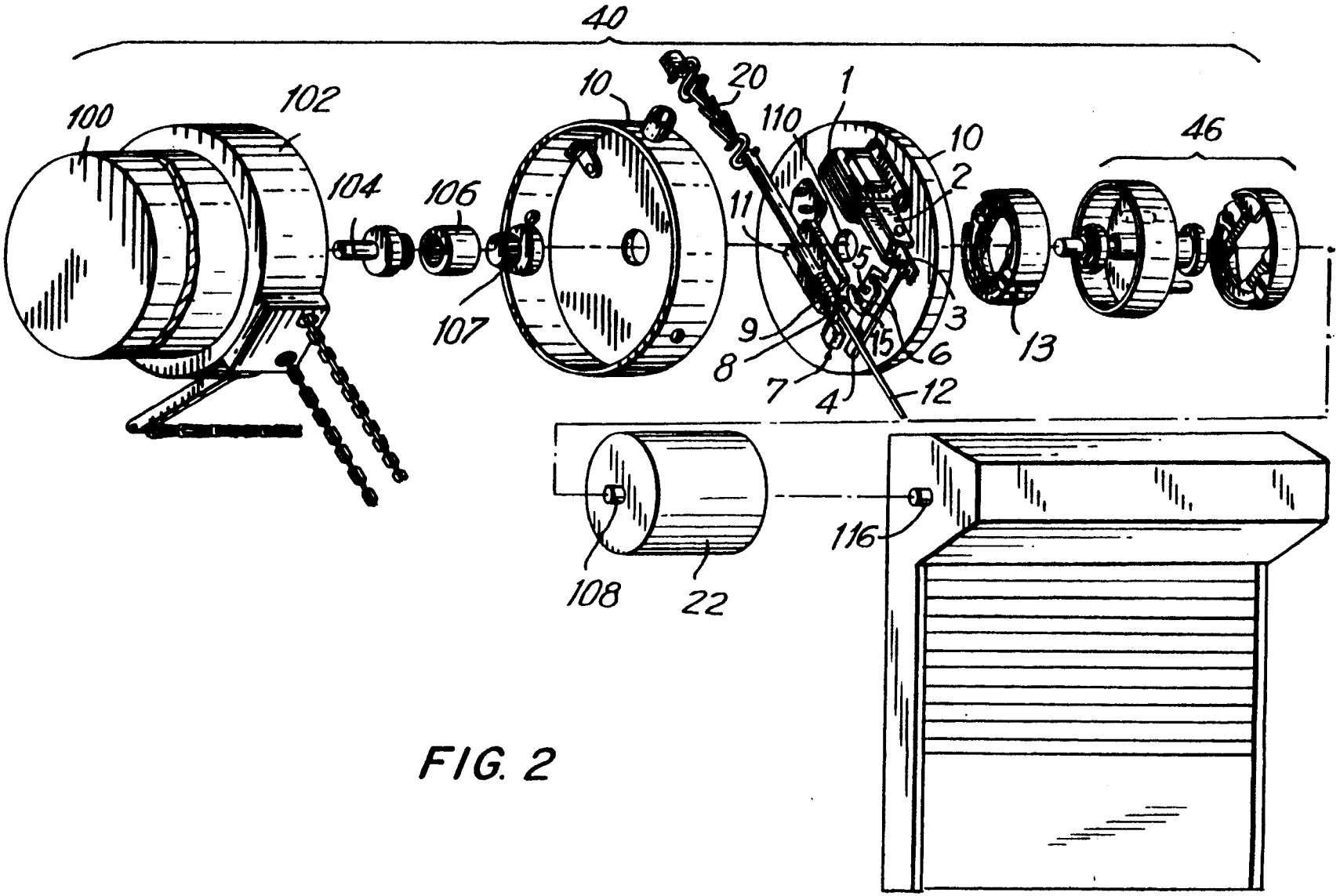
FIG. 2 is a partial exploded view of a motor-operator incorporating the preferred embodiment.

Referring to FIGS. 1, solenoid (1), having plunger assembly (2) is connected in series through take-up spring (3) to lever (4) which is keyed to rotatable brake control shaft (5). The springs within the brake provide a torque to brake control shaft (5), tending to rotate it in a direction which releases brake (13) (FIG. 2). The torque that the energized solenoid (1) through spring (3) can exert on shaft (5) is always greater than the torque tending to release brake (13). Shaft (5) communicates with brake (13) such that when shaft (5) is rotated clockwise, as viewed in FIG. 1, brake (13) is released and when shaft (5) rotates counterclockwise as viewed in FIG. 2, brake (13) is engaged. A mechanism for brake adjustment consisting of slots in a fixed attachment (15) to shaft (5) allows one to adjust the angular position of shaft (5) relative to lever (4) and then to key shaft (5) to lever (4) in the desired position by tightening screws (6).

Referring to FIG. 1, when no electric current is flowing through solenoid (1), the brake springs apply an unbalanced torque to shaft (5) causing a clockwise rotation of shaft (5) and release of brake (13). When an electric current is flowing through solenoid (1), plunger assembly (2) retracts into the body of solenoid (1), overcoming the torque tending to rotate shaft (5) clockwise, rotating shaft (5) counterclockwise through lever (4) to apply the brake (13).

Although a functional unit can be constructed without spring (3), it is preferred. The function of spring (3) is to automatically compensate for brake pad wear. Mechanisms not having this spring, but instead, pivotally connecting plunger (2) directly to lever (4) can not ensure high cycle operation of 50,000 openings and closures without manual brake adjustment. A few hundred up and down operations in mechanisms not having spring (3) is the best that has been achieved in tests on a test door before manual adjustment was necessary. With spring (3) mechanisms currently being tested on a working test door already logged more than 25,000 cycles. Those skilled in the art of mechanical engineering can properly size spring (3) to optimally compensate for brake wear depending on the characteristics of the brake and the opposing torque of shaft (5).

Figure 3:
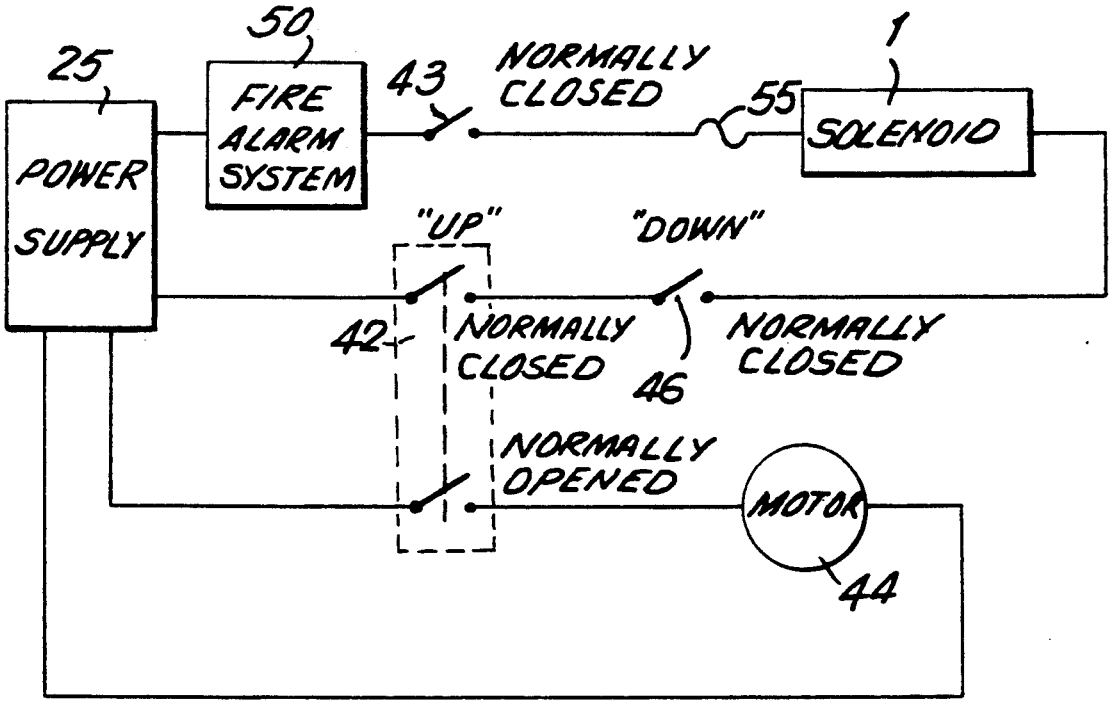
FIG. 3 is a wiring schematic drawing of the preferred embodiment.

As shown in the schematic diagram FIG. 3, the motion of a door 30 with a motor-operator 40 having this release mechanism can now be controlled by means of an operating panel. When the "up" button 42 is depressed, the control box, cuts power to solenoid (1) from power supply 25, thereby releasing brake (13) and simultaneously energizing a motor to lift the door. When the "down" button 46 is depressed, the control box cuts power to solenoid (1), thereby releasing brake (13) and the door descends under its own weight, its rate of descent controlled by a governor 48. When both the up button 42 and the down button 46 are released in a normal operation, the solenoid 1 is again energized, thus applying the brake (13) and stopping the door 30 in its desired position. As will be apparent by one who has read the description, the door 30 is always automatically set to descend in response to an event which cuts the power to solenoid (1).

A fire alarm system 50, having a signal output can be connected to the control panel or directly to a relay, or other current interrupting device electrically in series with solenoid (1) so that an alarm signal will interrupt current to solenoid (1), either directly or indirectly, thereby closing the door 30. For the purposes of failsafe operation of the alarm, an alarm signal with reverse logic (low output to a current interrupting device to interrupt solenoid current) is preferred.

It is preferrable, only because NFPA 80 currently requires it, to also include a means for releasing the door that is responsive to mechanical alarm inputs such as the melting of a fusible link 20 or manual operation. In the present invention, melting of the fusible link releases spring 52 loaded plunger (9) that depresses actuator (8) of normally closed switch (7). Said switch (7) in its closed position, normally completes the circuit supplying electric current to solenoid (1). Depressing actuator (8) of normally closed switch (7) opens switch (7) thereby interrupting the current to solenoid (1). It is forseeable that the failsafe nature of this invention acting in conjunction with a failsafe fire alarm will result in the NFPA, amending the section of NFPA 80 requiring fusible link activation. At such time, the spring 52 loaded plunger (9) and switch (7) may not be necessary.

Referring to FIG. 1, normally closed switch (7), having a mechanical actuator (8) is wired in series with solenoid (1). Spring loaded plunger (9), having a first end internal to the motor-operator unit case (10) and a second end external to the motor-operator unit case (10) is slideably mounted in frame (11) from a first released position where the internal end depresses mechanical actuator (8) to a second restrained position where the internal end does not depress mechanical actuator (8). The second external end of spring loaded plunger (9) is then pulled to the second restrained position and held there by one end of a chain containing a fusible link 20 with a melting temperature of about 135 degrees Fahrenheit. The fusible link and second end of the chain is located external to the motor operator unit 40. Placement of the fusible link 20 and the anchor point for the second end of the chain and the use of turnbuckles for tensioning the chain are done in accordance with standard industry practice.

If the fusible link 20 should melt, plunger (9) will move from its second restrained position to its first released position, thereby depressing actuator (8) which opens switch (7) which interrupts current to solenoid (1) which releases the brake (13) and allows the door to close.

Cable (12), having a first end connected to actuator (8) and a second free end external to the motor-operator unit case (10), allows for manual operation of switch (7). Manually pulling cable (12) will open switch (7) to interrupt power to solenoid (1), the brake 13 will release and the door will descend until the door is closed or until cable (12) is released, whichever comes first. Switch (7) will automatically close upon release of cable (12) and the brake 13 will be applied and stop the door's descent. This is useful during testing of the door to prove functional operation of switch (7). A knot or other type of mechanical stop (not shown) should preferably be placed on cable (12) internal to case (10) to allow movement of actuator (8) in its normal range, but not beyond, so that too hard a pull will not damage switch (7).

Annual or biannual testing of the fire door 30 having the preferred embodiment of the invention just described would be accomplished in accordance with the following procedure:

1) Fully raise the door by pressing the "up38 button 42 on the operating panel.

2) Activate the fire alarm and observe that the door descends smoothly and closes fully.

3) Deactivate the fire alarm and fully raise the door by pressing the "up" button 42 on the operating panel.

4) Pull cable (12) and observe that the door starts descending.

5) Release cable (12), and press the "up" button 42 to raise the door to its desired position.

The door 30 has now been fully tested, yet it is completely operational without the need for additional factory service. The door can be opened and closed in normal operation by pressing the appropriate buttons on the control panel but will always be automatically set to close during emergency operation.

In the event of an outage, the release mechanism will cause the door 30 to descend under its own weight. If the outage is very brief, the door will not have moved much before the solenoid is again energized, the brake applied, and the door's downward descent stopped, so that resetting may not be necessary. For longer outages that partially or fully close the door, the "up" button 42 is depressed when electric power is restored to raise the door 30 to its desired position. Nothing more needs to be done; the door 30 is always automatically set to close during emergency operation.

A preferable safety feature, which does not affect the normal operation of the invention but protects against defective solenoids, should be incorporated into the invention. It is a fuse 55 wired in series with solenoid (1). Energized solenoids have been known to short circuit and weld themselves shut in the closed position. Although this is a very rare occurrence, it does happen. A fuse rated at about 50% greater than the maximum normal current draw of the solenoid protects against this occurrence. If solenoid (1) develops a defect and draws excess current, the fuse 55 will blow and interrupt current to the solenoid 1 before any welding can take place. Shaft (5) will then rotate clockwise in its previously described fashion to release brake (13) and allow the door to close. If this condition occurs, replacement of solenoid (1) and the fuse 55 is necessary to restore braking operation to the door.

A motor-operator unit 40 incorporating the present invention is illustrated in FIG. 2. The motor operator unit 40 includes a means, such as a motor (not shown) disposed in a cylindrical housing and having a high starting torque, for rotating a high speed input shaft 108. The drive shaft of the motor (not shown) passes through a hand chain assembly (not shown) disposed in cylindrical collar 102 secured to motor housing 100 and serves to drive a knurled shaft 104 in operative engagement with coupling 106, having a knurled interior. The coupling 106 is also in operative engagement with a knurled coupling 107 which passes through a hole 110 in support plate 114 of brake 13 and is operatively engaged to input shaft 108. The input shaft 108 drives a low speed output shaft of reversibly desirable spaced reduction means 22 in order to raise or lower door 30. The motor operator unit 40 is ideally suited to function with auxillary features, such as, but not limited to, obstruction sensing devices, limit switches and timer controls. Those skilled in the art can readily wire the control box logic to operate the door with these and other additional features. All that needs to be kept in mind for operation of the door is:

1) To raise the door, a motor on signal which completes the circuit to the motor is accompanied by a signal which interrupts power to solenoid (1).

2) To lower the door, a motor off signal which cuts power to the motor is accompanied by a signal which interrupts power to solenoid (1).

3) To stop the door, a motor off signal is accompanied by a signal which energizes solenoid (1).

Power outages will of course overide any motorized or braking operation of the door, including momentary raising of the door in response to obstruction sensing devices. The door will automatically descend to its closed position. Adherence to NFPA 80 closing speed specifications should provide adequate safety protection during the occurrence of total power loss.

Fire doors operating in explosive environments such as paint shops, flour mills, etc., preferrably substitute for the electric motor, a pneumatic or hydraulic motor and pneumatic or hydraulic motor control logic, which perform the same function in the same way to achieve the same result as an equivalent electric motor and control box. The only difference is that pneumatic and hydraulic components have no spark sources to ignite an explosive atmosphere.

Similarly, a fail-safe fire door release mechanism can be made to be an equivalent of the preferred embodiment described, for example, by substituting, a pneumatic cylinder for the solenoid, air pressure for the electric current and normally closed pneumatic switches, pneumatically in series with the pneumatic cylinder to control the presence or absence of air pressure to the pneumatic cylinder, instead of electric switches. Pressure greater than a threshold pressure in the pneumatic cylinder would release the brake, and pressure less than a threshold pressure would apply the brake.

Although a specific embodiment of the present invention has been described in detail above, it is readily apparent that those skilled in the art may make various modifications and changes to the present invention without departing from the spirit and scope thereof. These changes include but are not limited to the addition of different features to the invention, the substitution of equivalent elements of the invention which perform substantially the same function in substantially the same way to achieve substantially the same result, or the incorporation of the invention in other equipment. It is to be expressly understood that the scope of the invention is defined by the following claims:

What is claimed is:

1. An improved motor-operator unit for a fire door of the type having a high speed shaft rotatably driveable in a first direction, reversibly driveable speed reduction means for rotatably connecting said high speed shaft with a low speed shaft, means for connecting said low speed shaft to driving means for a fire door, said fire door opening responsive to said high speed shaft rotating in said first direction, a brake movable between a disengaged position and an engaged position, said brake in said disengaged position allowing free rotation of said high speed shaft, said brake in said engaged position preventing rotation of said high speed shaft, wherein the improvement, a fail-safe door release mechanism comprises:

(a) a solenoid having an open state in the absence of an applied electric current and a closed state in the presence of an applied electric current; and (b) means for communicating said states of said solenoid with said brake, said means switching said brake to said disengaged position in response to said open state of said solenoid, said means switching said brake to said engaged position in response to said closed state of said solenoid.

2. An improved motor-operator unit for a fire door as claimed in claim 1 further comprising:

(a) a normally closed electrical switch wired in series with said solenoid, said switch having a first open position which blocks the flow of electric current to said solenoid and a second normally closed position which allows the flow of electric current to said solenoid, said switch having a mechanical actuator, said actuator movable between a first and a second position, said switch having said first open position when said actuator is in said actuator's second position, said switch having said second normally closed position when said actuator is in said actuator's first position; and, (b) mechanical means responsive to the melting of a fusible link for moving said actuator from said actuator's first position to said actuator's second position.

3. An improved motor-operator unit for a fire door as claimed in claim 2 further comprising:

(a) a cable having a first and a second end, said first end attached to said actuator, said second end external to said motor-operator, so that pulling said cable will move said actuator from said actuator's first to said actuator's second position.

4. An improved motor-operator unit for a fire door as claimed in claim 1 wherein said solenoid comprises a plunger and a body, said means for communicating said states of said solenoid with said brake comprise:

(a) a lever keyed to a rotatable brake control shaft, said brake control shaft engaging said brake when said brake control shaft is rotated in a first direction, said brake control shaft disengaging said brake when said brake control shaft rotates in a second direction, said brake control shaft torsionally sprung to rotate in said second direction in the absense of a countertorque, said lever pivotally connected to said plunger at a point on said lever away from said brake control shaft shaft, said plunger slideably mounted in said body of said solenoid, said plunger drawn towards said body of said solenoid in said closed state, said plunger free to move away from said body of said solenoid in said open state so that said brake control shaft rotates in said first direction in response to said closed state of said solenoid and said brake control shaft rotates in said second direction in response to said open state of said solenoid.

5. The improved motor-operator unit for a fire as claimed in claim 1 wherein said high speed shaft is driven by an electric motor.

* * * * *